United States Patent [19]

Jones

[11] Patent Number: 4,534,715

[45] Date of Patent: Aug. 13, 1985

[54] TRAVELING VALVE ASSEMBLY

[76] Inventor: Roy C. Jones, 28111 Autumn La., Pinehurst, Tex. 77362

[21] Appl. No.: 523,844

[22] Filed: Aug. 17, 1983

[51] Int. Cl.[3] ..... F04B 39/08; F04B 21/04

[52] U.S. Cl. ..... 417/456; 417/511; 137/614.2

[58] Field of Search ..... 417/456.6, 458, 510.6, 417/514, 520; 137/614.2; 74/428.8 VA

[56] References Cited

U.S. PATENT DOCUMENTS

| | | | |
|---|---|---|---|
| B 429,434 | 2/1976 | Burkhardt | 74/424.8 VA |
| 1,697,299 | 1/1929 | Zublin | 417/456 |
| 2,702,511 | 2/1955 | McConnoltie | 417/511 |
| 3,578,886 | 9/1968 | Wind | 417/435 |

*Primary Examiner*—William L. Freeh
*Attorney, Agent, or Firm*—Neal J. Mosely

[57] ABSTRACT

A traveling valve assembly is provided for use in subsurface gravity type pumping systems and is responsive to reciprocating motion to manipulate a rotary valve head relative to a valve seat between open and closed positions, and to fluid pressure to manipulate a ball member and a slidable seal member relative to seat members between open and closed positions. Reciprocating motion is converted to rotary motion by means of a journaled spiral groove portion of the rotary valve member. The traveling valve assembly is provided with multiple seals to prevent high pressure gas from blowing through the pump when pumping oil.

24 Claims, 11 Drawing Figures

TRAVELING VALVE ASSEMBLY

BACKGROUND OF THE INVENTION

1. FIELD OF THE INVENTION

This invention relates to improvements in subsurface pumps and more particularly to a traveling valve assembly providing a positive shut off and seal for preventing fluid loss and controlling gas or air pressure which might otherwise damage the pumping system.

2. BRIEF DESCRIPTION OF THE PRIOR ART

In producing oil wells it is common practice to provide a pump at the bottom of the well bore or at least down the well in the producing formation. The pump is normally actuated by reciprocation of the pump plunger by sucker rods which extend through the well bore from a reciprocating device at the surface of the ground and into connection with the pump. The reciprocating device at the surface is usually a horsehead type pump and alternately raises and lowers the string of sucker rods in the well bore.

It is frequently necessary during the pumping operation to pull the pipe or casing from the well to repair or replace the parts of the pump which is very costly and time consuming. Failure of the pump and resulting fluid loss may be caused by wear, sand packing in the ports and moving parts, and excessive gas pressures. Pump systems are known in the prior art. There are several patents which illustrate various pump assemblies.

MaGee, U.S. Pat. No. 1,698,163 discloses a valve cage for use in the working barrels of oil wells. The device is interposed in the pump rod of the well normally preventing the downward flow of fluid therein while the pump rod is being operated, but which may be opened to prevent the return of the oil in the upper portion of the casing whenever it is desired to withdraw the pump rod or casing.

Vickers, U.S. Pat. No. 2,669,939 discloses a deep well pump comprising a lower standing valve, an outlet valve, and a relief valve which cooperate to provide a straight unobstructed course for the upward flow of the liquid being pumped. The pump may be pulled from the well without pulling the well tubing.

Stevenson, U.S. Pat. No. 2,787,964 discloses a sectional liner pump comprising a seating shoe, a stationary barrel, and an outer shell. The lower end of the shell carries a standing valve. A rod guide is fixed to the top of the seating body and a the lower end of a reciprocating rod string is fixed to a plunger which carries a traveling valve.

Wells, U.S. Pat. No. 3,212,444 discloses a pump adapted to pump liquid from multiple zones. The pump comprises an upper and lower pump barrel. A standing valve controls flow through the lower barrel and a second standing valve controls flow through the upper barrel. Reciprocating upper and lower plunger disposed in the barrels are connected by a connecting rod having a main passageway. A lower traveling valve controls the flow through the main passageway.

Tolbert, U.S. Pat. No. 3,592,567 discloses a subsurface pump wherein a passageway is provided for directing a lubricant into the annulus between the working barrel and the pump plunger for facilitating the reciprocation of the plunger. The pump comprises a lower traveling valve and an upper back pressure valve.

Other patents of interest are; Le Bus, U.S. Pat. No. 1,694,329 disclosing a rotary pump, Fisher, U.S. Pat. No. 2,815,925 disclosing valves for controlling fluids in well bores, and Redpath, U.S. Pat. No. 2,572,388 disclosing a safety joint for well swabs.

The prior art in general, and none of these patents in particular, disclose a traveling valve assembly for use in subsurface gravity type pumping systems having the advantages of the present invention. The prior art does not suggest a traveling valve assembly which is responsive to reciprocating motion to manipulate a rotary valve member relative to a valve seat between open and closed positions, and to fluid pressure to manipulate a ball member and a slidable seal member relative to seat members between open and closed positions.

SUMMARY OF THE INVENTION

It is therefore an object of the present invention to provide a traveling valve assembly having multiple seals for preventing high pressure gas from blowing through a pump when pumping oil.

Another object of this invention is to provide a traveling valve assembly which when installed in a pumping system will extend the service life of the pumping units.

Another object of this invention is to provide a traveling valve assembly which when installed in a pumping unit will aid in increasing production by reducing fluid loss.

Another object of this invention is to provide a traveling valve assembly which will be reciprocally and rotationally responsive.

Another object of this invention is to provide a traveling valve assembly which may be installed in different positions within a pumping system.

Other objects of the invention will become apparent from time to time throughout the specification and claims as hereinafter related.

The above noted objects and other objects of the invention are accomplished by a traveling valve assembly for use in subsurface gravity type pumping systems which is responsive to reciprocating motion to manipulate a rotary valve head relative to a valve seat between open and closed positions, and to fluid pressure to manipulate a ball member and a slidable seal member relative to seat members between open and closed positions. The reciprocating motion is converted to rotary motion by means of a journaled spiral groove portion of the rotary valve member. The traveling valve assembly is provided with multiple seals to prevent high pressure gas from blowing through the pump when pumping oil.

DESCRIPTION OF A PREFERRED EMBODIMENT

Conventional pumping systems are well known and the following description is merely general in nature so that those skilled in the art may understand the placement of the present invention within the system.

Figure 1:
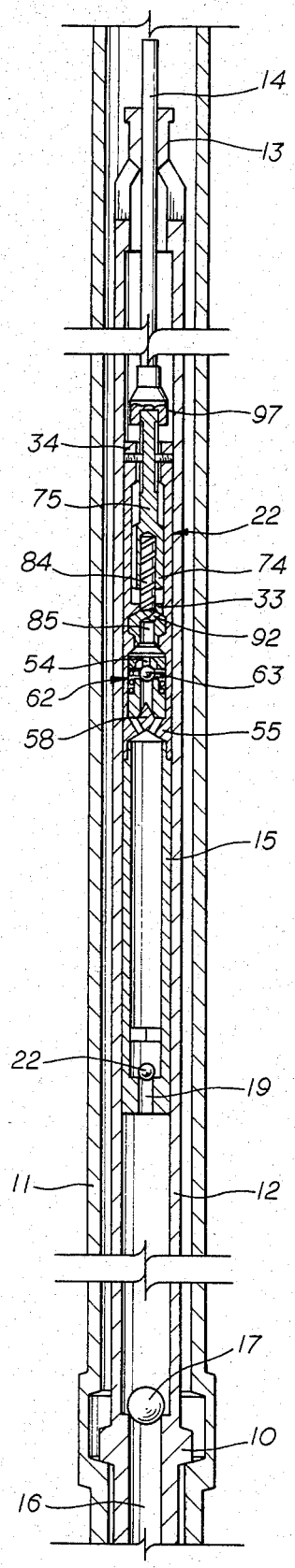
FIG. 1 is a schematic view in vertical cross section through a well pipe and pump with a traveling valve assembly installed in the top sealing position.
Figure 2:
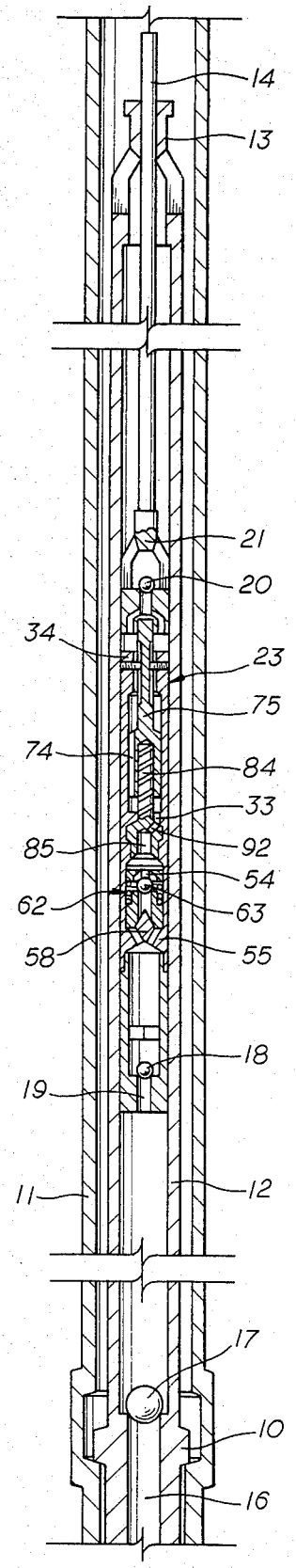
FIG. 2 is a schematic view in vertical cross section through a well pipe and pump with an alternate traveling valve assembly instlled in the intermediate sealing position.
Figure 3:
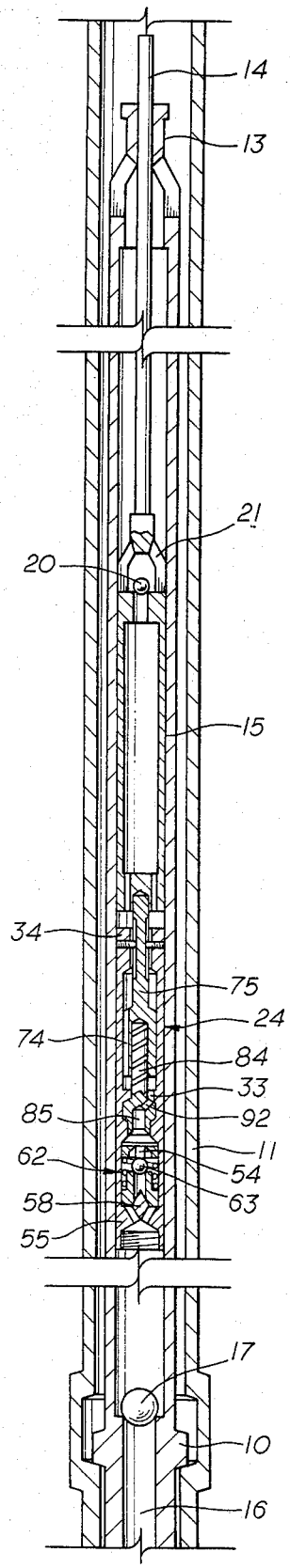
FIG. 3 is schematic view in vertical cross section through a well pipe and pump with another alternate traveling valve assembly installed in the bottom sealing position.

Referring to the drawings by numerals of reference and more particularly to FIGS. 1, 2, and 3, there is shown schematically a preferred traveling valve assembly interposed at various locations within a conventional pumping system.

A conventional gravity pumping system generally comprises a packer member 10 anchored inside the well bore pipe or casing 11 near the bottom of the formation. A section of casing or pipe extends upwardly from the packer 10 forming an outer barrel 12. At the upper end of outer barrel 12, a top member 13 fits around a sucker rod 14. A tubular plunger member 15 is reciprocally mounted inside the outer barrel 12 and actuated by reciprocation of the sucker rod 14. Sucker rod 14 extends through the well bore to a reciprocating device at the surface of the ground (not shown) such as a horsehead type pump which alternately raises and lowers the sucker rod 14 and plunger 15 inside the outer barrel 12.

The packer 10 is provided with a lower inlet port 16 and a standing valve 17 to control fluid communication between the exterior of the packer 10 and the plunger 15. The plunger 15 is provided with a lower traveling valve 18 and an inlet port 19 in its lower end. A second traveling valve 20 and outlet port 21 may be provided at the upper end of the plunger 15.

In FIGS. 1–3, the traveling valve is shown in different positions in the pump system where it may be used. In FIG. 1, a preferred traveling valve assembly 22 is interposed between the sucker rod 14 and the upper portion of the plunger 15. In this instance, the present traveling valve assembly 22 replaces the existing second traveling valve 20 at the upper end of the plunger 15. In FIG. 2, an alternate traveling valve assembly 23 is positioned within the tubular members of the plunger 15 below the existing second traveling valve 20. In FIG. 3, another traveling valve assembly 24 is positioned at the lower end of the plunger 15, replacing the existing lower traveling valve 18.

Figure 4A:
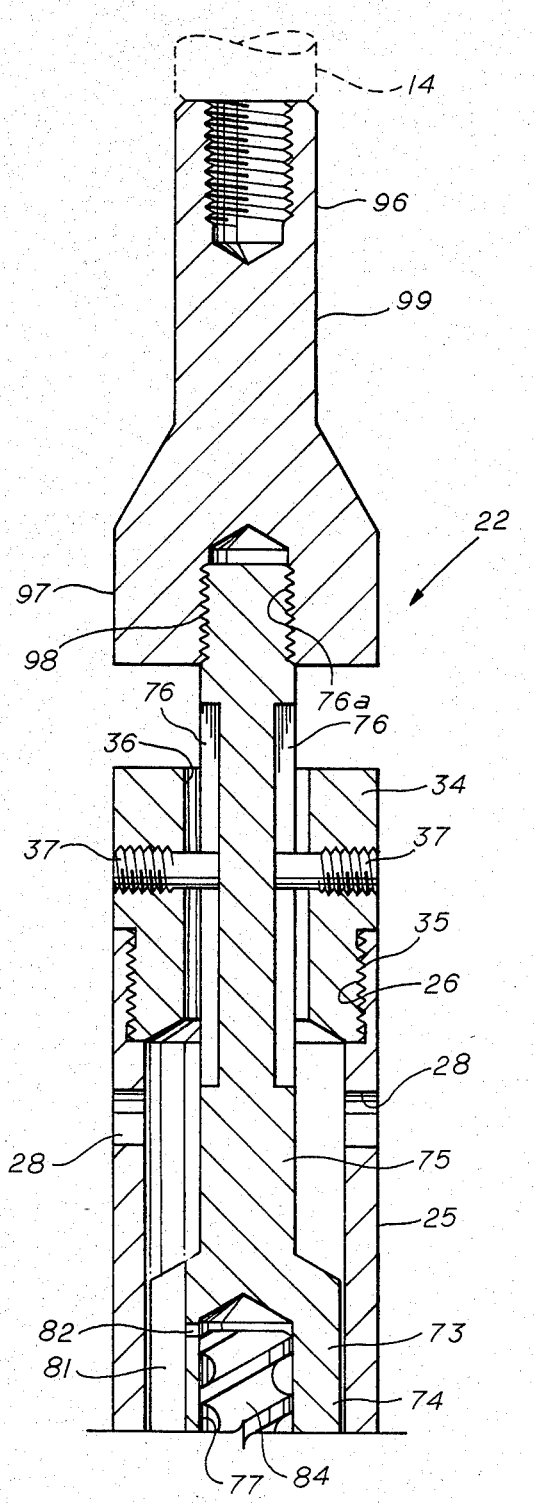
FIGS. 4A and 4B are continuation views in vertical cross section illustrating a traveling valve assembly constructed in accordance with this invention.
Figure 4B:
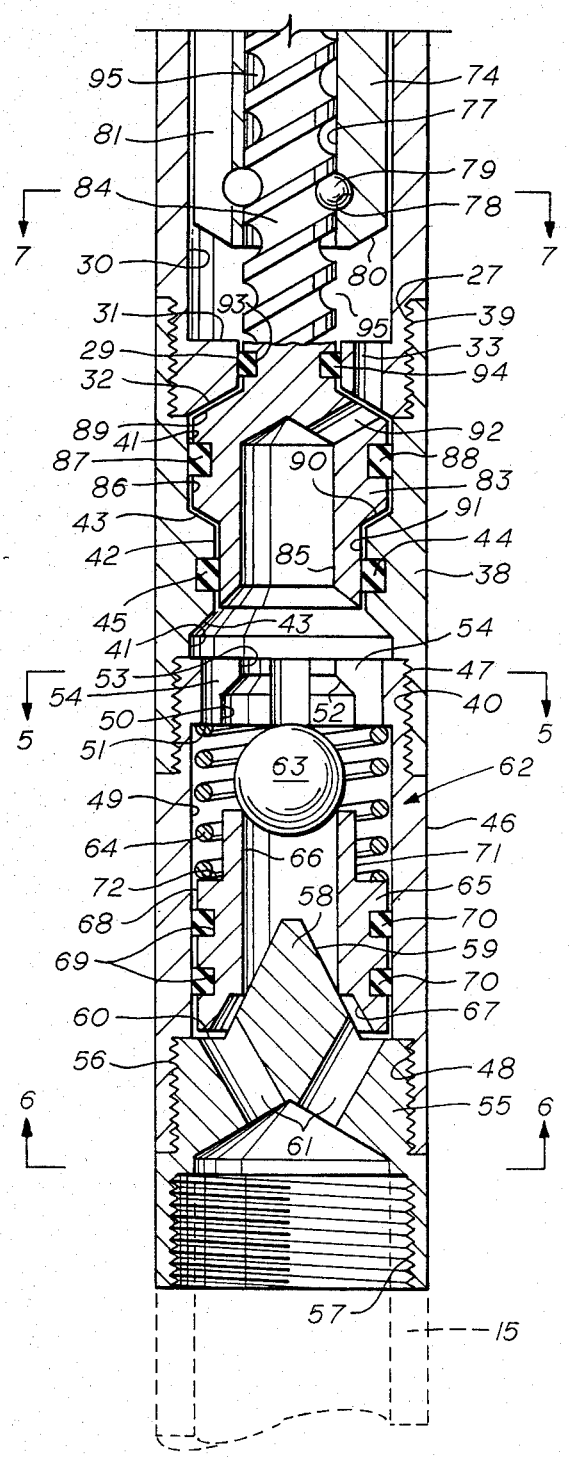
Figure 7:
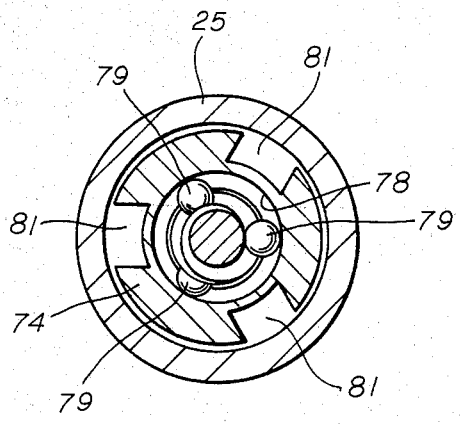
FIG. 7 is a horizontal cross sectional view taken along the line 7—7 of FIG. 4B.
Figure 5:
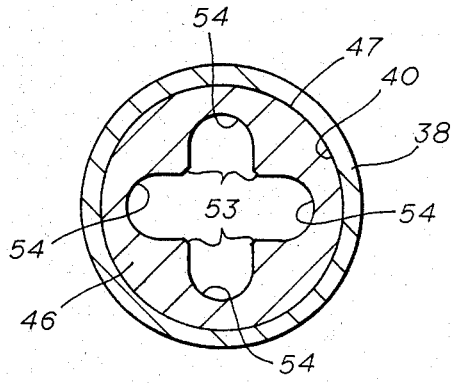
FIG. 5 is a horizontal cross sectional view taken along the line 5—5 of FIG. 4B.
Figure 6:
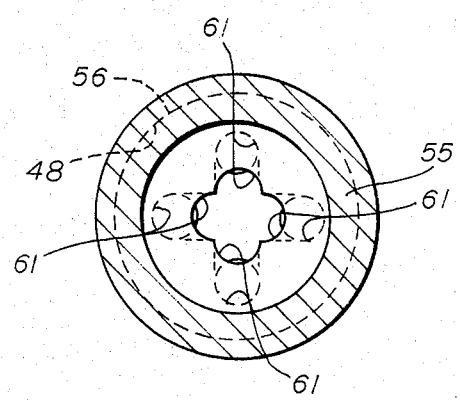
FIG. 6 is a horizontal cross sectional view taken along the line 6—6 of FIG. 4B.

Referring now to FIGS. 4A and 4B, and to FIGS. 5, 6, and 7, the traveling valve assembly 22 is shown to comprise several threadably attached tubular housings. An elongated tubular guide housing 25 has an internally threaded top end portion 26 (box thread) and an externally threaded bottom end portion 27. The upper end portion of guide housing 25 just below the threaded portion 26 has a plurality of circumferentially spaced fluid outlet ports 28 communicating between the interior and exterior of the housing.

Guide housing 25 has a smooth cylindrical bore 30 which ends at a reduced bore 29 defining a flat annular end wall 31. A centrally located conical seat 32 is provided just below the bore 29 in the bottom of the guide housing 25. A longitudinal port 33 extends through the flat annular end wall 31 to provide communication between the interior of the guide housing 25 and the conical seat 32.

A cylindrical guide cap 34 having an externally threaded pin portion 35 and a central bore 36 extending longitudinally therethrough is threadably attached to the box thread 26 of the guide housing 25. Guide pins 37 are adjustably and threadably secured in the guide cap 34 at diametrically opposed positions.

A cylindrical rotary guide housing 38 having internally threaded top and bottom portions 39 and 40 respectively is threadably secured to the threaded lower portion 27 of the guide housing 25. A cylindrical bore 41 extends between the box threads 39 and 40. A central bore 42 of reduced diameter defines an internal wall having two opposing conical surfaces 43. An annular groove 44 and seal 45 is provided in the bore 42 intermediate the conical surfaces 43.

A tubular upper seal housing 46 having an externally threaded top end portion 47 (pin thread) and an internally threaded bottom portion 48 (box thread) is threadedly attached to the threaded lower portion 40 of the rotary guide housing 38. A first bore 49 extends upwardly from the threaded lower portion 48 and terminates below the top end of the housing 46. A second bore 50 smaller than the first defines an annular flat shoulder 51 therebetween. An annular beveled seat 52 is provide between the second bore 50 and a central bore 53. Passageways 54 are provided in the seat 52 to establish communication between the upper and lower portions of the seal housing 46. The passageways 54 comprise a series of longitudinal slots spaced laterally from from the bore 53 and in communication therewith (FIG. 5).

A cylindrical lower seal housing 55 having external threads 56 (pin thread) on its outer periphery is threadedly attached to the threaded lower portion 48 (box thread) of the the upper seal housing 46. Lower seal housing 55 is provided with an internally threaded connection 57 (box thread) at its lower end for suitable connection with the appropriate section of a pump plunger 15. A truncated conical top portion 58 extends upwardly from the housing 55 to provide a conical sealing surface 59. The base of the conical portion 58 is of smaller diameter than the threads 56 defining an annular end wall or shoulder 60 therebetween. A series of passages 61 extend angularly upward and outward from the lower portion of the housing through the shoulder 60 providing communication between the upper and lower poritons of the housing 55 (FIG. 6).

A ball valve assembly 62 is positioned within the upper seal housing 46 between the seat 52 and the conical top surface 59 of the lower seal housing 55. The ball valve assembly 62 comprises a ball member 63 having a diameter larger than the bore 53, a compression spring 64, and a cylindrical sliding seal member 65. The sliding seal member 65 has a central bore 66 smaller than the diameter of the ball 63 for suitable seating therewith and smaller than the base of the conical top portion 58. A beveled counter bore 67 is provided in the bottom of the sliding seal 65.

The outer diameter 68 of the seal member 65 is smaller than first bore 49 of the upper seal housing 46 and provided with a pair of spaced annular grooves 69 containing seals 70 for sliding and sealing engagement with the bore 49. A reduced neck portion 71 smaller in diameter than the outer diameter 68 provides an annular shoulder 72 therebetween. The compression spring 64 is retained between the shoulder 51 and the shoulder 72. The spring 64 is of sufficient strength to bias the sliding seal 65 downward and effect a metal-to-metal seal on the angular sealing surface 59.

A cylindrical rotary guide member 73 is positioned for reciprocal movement within the guide housing 25 and has a cylindrical lower portion 74 and an upper stem portion 75. The stem portion 75 extends slidably through the central bore 36 of the cap member 34 and is provided with longitudinally extending surface grooves 76 receiving the guide pins 37. The top end of the stem 75 has an externally threaded portion 76*a*. A central longitudinal bore 77 extends from the bottom of the rotary guide 73 and terminates just below the stem portion 75. An inner groove 78 is provided near the bottom of the lower portion 74 to receive ball bearings 79. A bevel 80 is provided on the bottom of the rotary guide 73. A series of circumferentially spaced longitudinal slots 81 on the periphery of the lower portion 74 of the rotary guide 73 provide a fluid passageway between the sidewall of the guide housing 25 and the rotary guide 73. A relief port 82 allows communication between the slots 81 and the bore 77.

A rotary valve member 83 is positioned for rotation within the rotary housing 38 and has a stem portion 84 extending through the bore 29 and into the bore 77 of the rotary guide 73. The bottom portion of the rotary valve 73 is provided with a longitudinal bore 85 terminating below the reduced stem portion 84. The outer diameter 86 of the rotary valve 83 is smaller than the bore 41 of the rotary housing 38 and has an annular groove 87 containing a seal 88 for rotational and sealing contact therewith. Spaced from the groove 87 are oppositely extending conically beveled surfaces 89 and 90. Lower beveled surface 90 terminates in a portion 91 which is sufficiently smaller than the bore 42 and the seal 45 to provide rotational and sealing contact therewith.

The upper beveled surface 89 terminates at the reduced stem portion 84 and is positioned for sliding contact with conical surface 32 below shoulder 30. An angular valve port 92 extends upwardly and outwardly from the bore 85 terminating in axial alignment with the longitudinal port 33 to establish communication therebetween. The reduced stem portion 84 is provided with an annular groove 93 containing a seal 94 to provide rotational and sealing contact with the bore 29. A triple start spiral groove 95 is provided at the upper portion of the stem 84. The groove 95 is journaled in the bore 77 of the rotary guide 73 by means of the ball bearings 79 to reduce friction and to rotate the valve 83.

A coupling member 96 having a cylindrical bottom portion 97 is provided with internal threads 98 and threadedly attached thereby to the top end of the stem 75 of the rotary guide 73. The coupling member 96 has a reduced upper neck portion 99 provided with a threaded connection 100 for suitable connection with a sucker rod 14.

The traveling valve assembly 22 is designed so that it may be used in either an up stoke or a down stroke pumping application. Reciprocating motion of the existing sucker rod or pump plunger is transmitted to the rotary guide 73 where it is converted to rotary motion by means of the journaled sprial groove 95 of the rotary valve member 83. The rotary valve member 83 rotates 180° to place the angular fluid port 92 in alignment with the longitudinal port 33 and establish communication therethrough or to seal it off, depending upon the application.

OPERATION

The rotary valve member 83 is placed in the desired position with the ports 92 and 33 in alignment or 180° out of alignment. The correct amount of travel distance is determined, and the rotary guide 73 is set by turning it on the rotary stem 84 until its lower portion 74 bottoms out on the flat surface 31 or until it resides at the proper height above the surface 31. After the adjustments are made, the guide pins 37 are installed in position in the grooves 76. The traveling valve assembly 22 is now placed in the desired location of the pumping system.

Figure 8A:
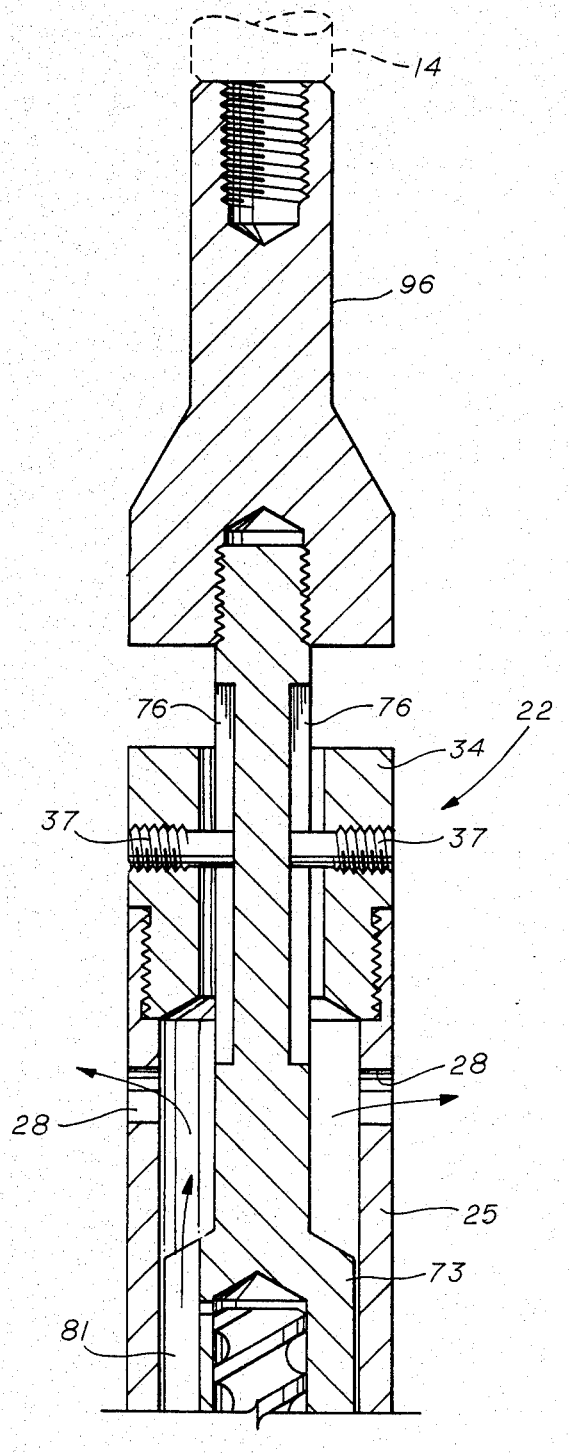
FIGS. 8A and 8B are continuation views in vertical cross section illustrating the fluid flow path through the traveling valve assembly constructed in accordance with this invention.
Figure 8B:
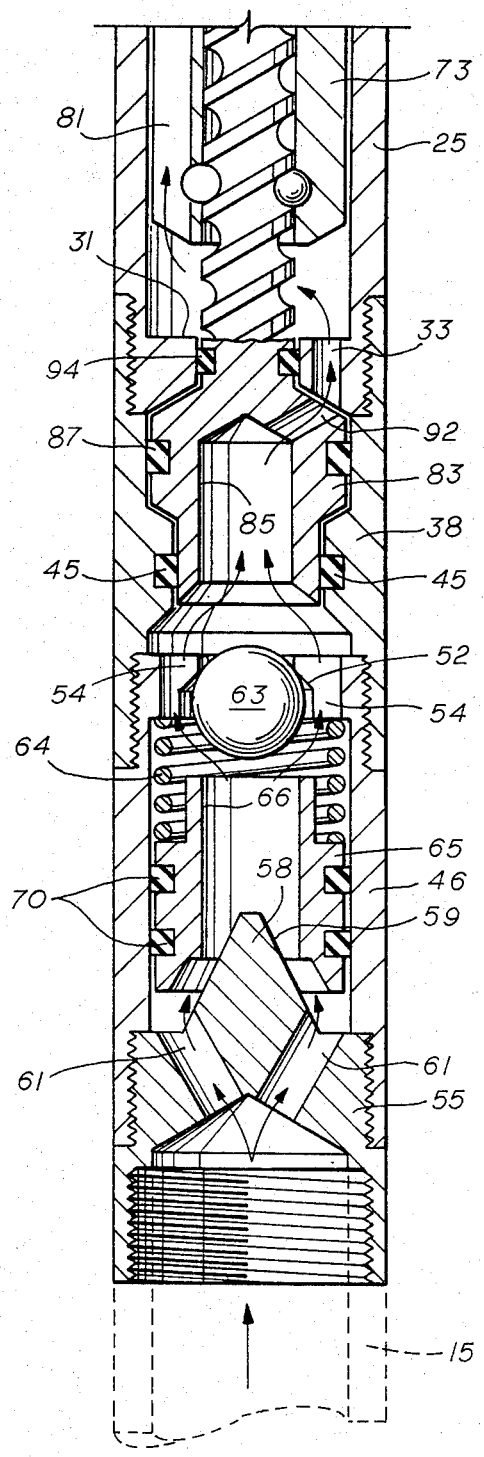

Referring now to FIGS. 8A and 8B, the traveling valve assembly 22 is placed between the sucker rod 14 and the top section of of the pump plunger 15. When the pump is in action, the fluid (indicated by arrows) passes through bores 61 in the lower seal housing 55, lifting the sliding seal 65 and compressing the spring 64. Trapped by the annular seals 70, the fluid travels around the conical top portion 58, and through the bore 66 to force the ball 63 against the seat 52. The fluid passes around the ball 63 through the passgeways 52 to enter the bore 85 in the lower portion of rotary valve 83.

Seals 45 and 88 prevent fluid and gasses from escaping around the lower portion of the rotary 83. If the rotary port 92 is in alignment with the port 33, the fluid passes through entering the guide housing 25. The seals 88 and 94 seal around the ports 92 and 33. The fluid passes around the rotary guide 73 through slots 81 and out through the top fluid ports 28.

Figure 9:
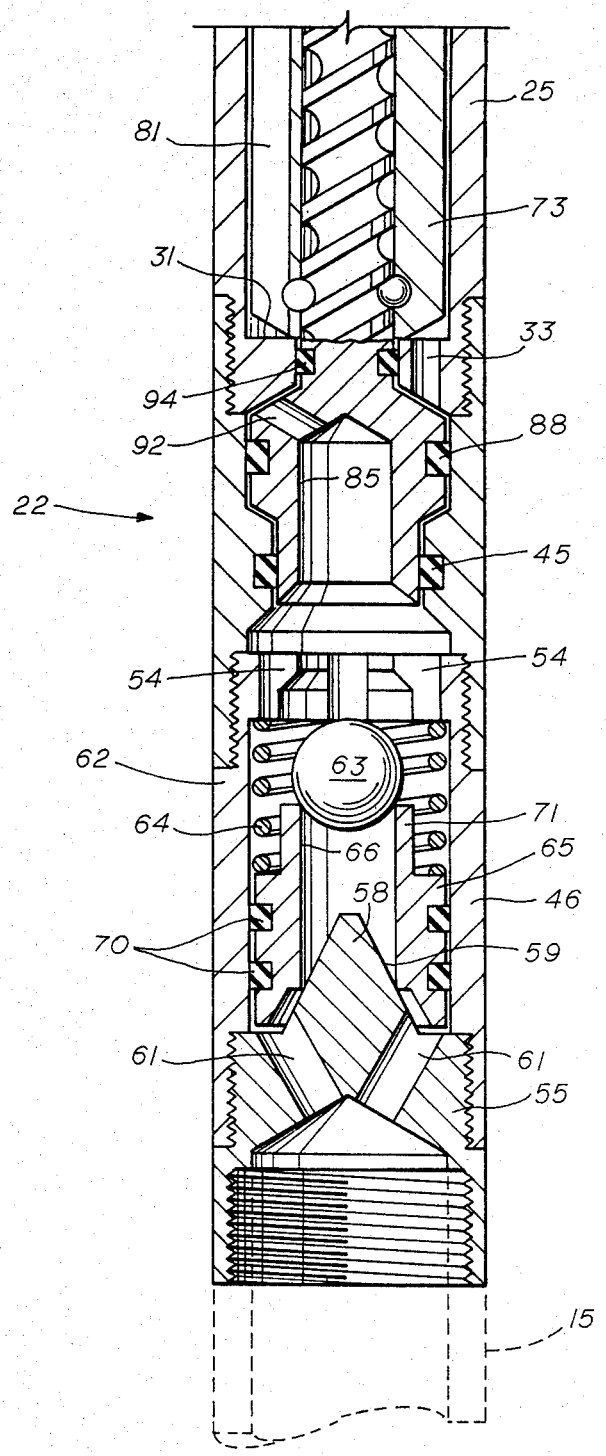
FIG. 9 is vertical cross section of a portion of the traveling valve assembly in a closed position.

Referring now to FIG. 9, the traveling valve assembly 22 is shown in the closed position. The lower portion of the rotary guide 73 is bottomed out on the flat surface 31 of the guide housing 25, and the rotary port 92 is rotated 180° from the port 33 to shut off circulation between the rotary housing 38 and the guide housing 25, fluid and gas pressure being contained by the seals 94, 88, and 45.

The ball valve assembly 62 acts as a back up sealing unit for the rotary valve. The ball 63 drops down to rest on the neck 71 of the sliding seal 65. The weight of the ball 63 and the force of spring 64 pushes the sliding seal 65 down to effect a metal-to-metal seal between it and the sealing surface 59 of the conical top portion 58, closing off the bores 61 in the lower seal housing 55 and the bore 66 in the sliding seal 65. The annular seals 70 further contain fluid and gas pressures. If for any reason the rotary 83 should begin to wear, the sliding seal 65 at the bottom remains operational to provide sealing action.

While this invention has been described with special emphasis on a preferred embodiment, it should be understood that within the scope of the appended claims the invention may be practiced otherwise than as specifically described herein.

I claim:

1. A traveling valve assembly adapted for connection in a pump housing, comprising a tubular housing having a normal vertical orientation with open top and bottom ends, a longitudinally movable check valve assembly positioned in the bottom end portion of said housing to receive fluid entering therein, and opening on flow of fluid upward and closing on cessation of upward flow of fluid, said housing having a valve port in an upper portion thereof, a rotary valve member positioned in operative engagement with said valve port and rotatable relative to said housing between a first position closing said valve port and a second position opening said valve port, a longitudinally reciprocally movable member extending from said valve member through said tubular housing and out of the top end thereof, means securing said reciprocally movable member against rotation in relation to said housing while permitting longitudinal movement, mechanical linkage means interconnecting said reciprocally movable member and said valve member operable to convert longitudinal reciprocal movement of said movable member to rotary movement of said valve member relative to said housing, whereby movement of said movable member a predetermined distance in one direction rotates said rotary valve member to said first position and thereafter movement of said movable member a predetermined distance in the other direction rotates said rotary valve member to said second position.

2. A traveling valve assembly according to claim 1 in which said open bottom end of said housing is sized and threaded for connection in a pump housing, and said reciprocally movable member includes coupling means for connection to a pump actuating rod.

3. A traveling valve assembly according to claim 1 in which said check valve assembly comprises a ball check valve.

4. A traveling valve assembly according to claim 3 in which said check valve assembly includes a seal member secured in said bottom open end of said housing, a tubular valve seat member with valve seats at opposite ends thereof, one of said valve seats being engagable with said seal member, a ball valve engagable with the other valve seat of said tubular valve seat member, and spring means biasing said tubular valve seat member toward engagement with said seal member, whereby fluid entering said housing through said bottom end moves said tubular valve seat member away from said seal member and said ball valve to an open position.

5. A traveling valve assembly according to claim 4 in which said housing includes an inwardly directed flange portion spaced from said seal member, said tubular valve seat member having an upper end portion of reduced diameter defining a peripheral flange and having said other valve seat at the end thereof, sealing means on the peripheral surface of said tubular valve seat member providing a sliding seal with the wall of said housing, and said spring means comprising a helical spring surrounding said reduced diameter portion of said valve seat member and compressively positioned between said peripheral flange and said housing flange to bias said valve seat member toward engagement with said seal member.

6. A traveling valve assembly according to claim 1 in which said housing has a first inwardly directed flange with said valve port extending therethrough, a second inwardly directed flange spaced a predetermined distance below said first flange, and said rotary valve member being hollow and guided between said first and second flanges for said rotary movement, and having a port extending therethrough and aligned with said valve port in said second position of rotary movement.

7. A traveling valve assembly according to claim 6 in which said rotary valve member has a drive stem portion extending upwardly therefrom, said longitudinally reciprocally movable member having a portion shaped to fit said drive stem in telescoping relation, and said drive stem portion and said movable member telescoping portion having a helical drive thread on one member and a fixed drive member on the other member comprising said mechanical linkage means for converting longitudinal reciprocal movement of said movable member to rotary movement of said valve member.

8. A traveling valve assembly according to claim 7 in which said rotary valve member drive stem portion has a helical drive thread extending upwardly on the surface thereof, said longitudinally reciprocally movable member having a hollow portion fitting over said drive stem threaded portion in telescoping relation, and having an internal race with a ball bearing positioned therein, said helical drive thread having a semicircular cross section fitting said ball bearing in driving relation, and longitudinal reciprocal movement of said movable member effecting driving movement of said ball bearing relative to said drive thread to produce said valve member rotary movement.

9. A traveling valve assembly according to claim 1 in which said housing includes guide means for longitudinal movement of said movable member restraining the same against rotary movement.

10. A traveling valve assembly according to claim 1 in which said housing is formed in a plurality of sections.

11. A traveling valve assembly according to claim 1 in which said open bottom end of said housing is sized and threaded for connection in a pump housing, said reciprocally movable member includes coupling means for connection to a pump actuating rod, said check valve assembly comprises a ball check valve, said check valve assembly includes a seal member secured in said bottom open end of said housing, a tubular valve seat member with valve seats at opposite ends thereof, one of said valve seats being engagable with said seal member, a ball valve engagable with the other valve seat of said tubular valve seat member, and spring means biasing said tubular valve seat member toward engagement with said seal member, whereby fluid entering said housing through said bottom end moves said tubular valve seat member away from said seal member and said ball valve to an open position.

12. A traveling valve assembly according to claim 11 in which said housing includes an inwardly directed flange portion spaced from said seal member, said tubular valve seat member having an upper end portion of reduced diameter defining a peripheral flange and having said other valve seat at the end thereof, sealing means on the peripheral surface of said tubular valve seat member providing a sliding seal with the wall of said housing, and said spring means comprising a helical spring surrounding said reduced diameter portion of said valve seat member and compressively positioned between said peripheral flange and said housing flange to bias said valve seat member toward engagement with said seal member.

13. A traveling valve assembly according to claim 1 in which said housing has a first inwardly directed flange with said valve port extending therethrough, a second inwardly directed flange spaced a predetermined distance below said first flange, said rotary valve member being hollow and guided between said first and second flanges for said rotary movement, and having a port extending therethrough and aligned with said valve port in said second position of rotary movement, said rotary valve member has a drive stem portion extending upwardly therefrom and has a helical drive thread extending upwardly on the surface thereof, said longitudinally reciprocally movable member having a portion shaped to fit said drive stem in telescoping relation, and said longitudinally reciprocally movable member having a hollow portion fitting over said drive stem threaded portion in telescoping relation, and having an internal race with a ball bearing positioned therein, said helical drive thread having a semicircular cross section fitting said ball bearing in driving relation, and said helical drive thread on one member and said ball bearing member comprising said mechanical linkage means for converting longitudinal reciprocal movement of said movable member to rotary movement of said valve member.

14. A traveling valve assembly according to claim 12 in which said rotary valve member drive stem portion has a helical drive thread extending upwardly on the surface thereof, said longitudinally reciprocally movable member having a hollow portion fitting over said drive stem threaded portion in telescoping relation, and having an internal race with a ball bearing positioned therein, said helical drive thread having a semicircular cross section fitting said ball bearing in driving relation, and longitudinal reciprocal movement of said movable member effecting driving movement of said ball bearing relative to said drive thread to produce said valve member rotary movement.

15. A traveling valve assembly according to claim 12 in which said housing includes guide means for longitudinal movement of said movable member restraining the same against rotary movement.

16. A traveling valve assembly according to claim 12 in which said housing is formed in a plurality of sections.

17. A pump assembly comprising, in combination a tubular pump housing providing a working chamber, a movable barrel positioned for longitudinal reciprocal movement in said housing working chamber, a standing valve at the bottom of said housing, a sucker rod for moving said barrel, a traveling valve assembly secured on said barrel comprising a tubular valve assembly housing having a normal vertical orientation with open top and bottom ends, a longitudinally movable check valve assembly positioned in the bottom end portion of said valve assembly housing to receive fluid entering therein, and opening on flow of fluid upward and closing on cessation of upward flow of fluid, said valve assembly housing having a valve port in an upper portion thereof, a rotary valve member positioned in operative engagement with said valve port and rotatable between a first position closing said valve port and a second position opening said valve port, a longitudinally reciprocally movable member extending from said valve member through said tubular valve assembly housing out of the top end thereof and connected to said sucker rod, mechanical linkage means interconnecting said reciprocally movable member and said valve member operable to convert longitudinal reciprocal movement of said movable member to rotary movement of said valve member, whereby movement of said barrel is effective to move liquid in said working chamber and movement of said movable member a predetermined distance in one direction rotates said rotary valve member to said first position and thereafter movement of said movable member a predetermined distance in the other direction rotates said rotary valve member to said second position.

18. A pump assembly according to claim 17 in which said check valve assembly comprises a ball check valve, said check valve assembly includes a seal member secured in said bottom open end of said valve assembly housing, a tubular valve seat member with valve seats at opposite ends thereof, one of said valve seats being engagable with said seal member, a ball valve engagable with the other valve seat of said tubular valve seat member, and spring means biasing said tubular valve seat member toward engagement with said seal member, whereby fluid entering said housing through said bottom end moves said tubular valve seat member away from said seal member of said ball valve to an open position.

19. A pump assembly according to claim 18 in which said valve assembly housing includes an inwardly directed flange portion spaced from said seal member, said tubular valve seat member having an upper end portion of reduced diameter defining a peripheral flange and having said other valve seat at the end thereof, sealing means on the peripheral surface of said tubular valve seat member providing a sliding seal with the wall of said valve assembly housing, and said spring means comprising a helical spring surrounding said reduced diameter portion of said valve seat member and compressively positioned between said peripheral flange and said housing flange to bias said valve seat member toward engagement with said seal member.

20. A pump assembly according to claim 17 in which said valve assembly housing has a first inwardly directed flange with said valve port extending therethrough, a second inwardly directed flange spaced a predetermined distance below said first flange, and said rotary valve member being hollow and guided between said first and second flanges for said rotary movement, and having a port extending therethrough and aligned with said valve port in said second position of rotary movement.

21. A pump assembly according to claim 20 in which said rotary valve member has a drive stem portion extending upwardly therefrom, said longitudinally reciprocally movable member having a portion shaped to fit said drive stem in telescoping relation, and said drive stem portion and said movable member telescoping portion having a helical drive thread on one member and a fixed drive member on the other member comprising said mechanical linkage means for converting longitudinal reciprocal movement of said movable member to rotary movement of said valve member.

22. A pump assembly according to claim 21 in which said rotary valve member drive stem portion has a helical drive thread extending upwardly on the surface thereof, said longitudinally reciprocally movable member having a hollow portion fitting over said drive stem threaded portion in telescoping relation, and having an internal race with a ball bearing positioned therein, said helical drive thread having a semicircular cross section fitting said ball bearing in driving relation, and longitudinal reciprocal movement of said movable member effecting driving movement of said ball bearing relative to said drive thread to produce said valve member rotary movement.

23. A pump assembly according to claim 17 in which said valve assembly housing includes guide means for longitudinal movement of said movable member restraining the same against rotary movement.

24. A pump assembly according to claim 17 in which said valve assembly housing is formed in a plurality of sections.

* * * * *